US011035219B2

(12) United States Patent
Orban

(10) Patent No.: US 11,035,219 B2
(45) Date of Patent: Jun. 15, 2021

(54) SYSTEM AND METHOD FOR DRILLING WEIGHT-ON-BIT BASED ON DISTRIBUTED INPUTS

(71) Applicant: Schlumberger Technology Corporation, Sugar Land, TX (US)

(72) Inventor: Jacques Orban, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 440 days.

(21) Appl. No.: 15/976,473

(22) Filed: May 10, 2018

(65) Prior Publication Data

US 2019/0345811 A1 Nov. 14, 2019

(51) Int. Cl.

| | |
|---|---|
| ***E21B 44/00*** | (2006.01) |
| ***E21B 44/04*** | (2006.01) |
| ***E21B 47/12*** | (2012.01) |
| ***E21B 45/00*** | (2006.01) |
| ***E21B 7/00*** | (2006.01) |

(52) U.S. Cl.

CPC ..... *E21B 44/04* (2013.01); *E21B 7/00* (2013.01); *E21B 45/00* (2013.01); *E21B 47/12* (2013.01)

(58) Field of Classification Search

CPC ..... E21B 44/00; E21B 44/04; E21B 47/12
See application file for complete search history.

(56) References Cited

U.S. PATENT DOCUMENTS 4,940,117 A * 7/1990 Ovaska ..... B66B 1/40 187/247
5,713,422 A * 2/1998 Dhindsa ..... E21B 19/08 173/4
6,892,812 B2 5/2005 Niedermayr et al.
6,896,055 B2 5/2005 Koithan
6,931,621 B2 8/2005 Green et al.
7,172,037 B2 2/2007 Dashevskiy et al.
7,264,050 B2 9/2007 Koithan et al.
(Continued)

FOREIGN PATENT DOCUMENTS

WO 2017204655 A1 11/2017
WO 2018186745 A1 10/2018

*Primary Examiner* — Cathleen R Hutchins
*Assistant Examiner* — Ronald R Runyan
(74) *Attorney, Agent, or Firm* — Jeffrey D. Frantz

(57) ABSTRACT

A system to control a drilling of a wellbore may include a drill string within the wellbore, wherein a wired communication system is along the drill string, at least one measurement sub configured to monitor at least one drilling parameter connected to the drill string and the at least one measurement sub being connected to the wired communication system; a drill bit at a distal end of the drill string; a drawwork mechanically coupled to the drill string and configured to lower the drill string attached thereto in the wellbore; a power controlling electronic connected to a motor of the drawwork, configured to control a drawwork unspooling speed; and a surface controller in communication with the power controlling electronic of the drawwork configured to: determine at least one drilling parameter along the drill string from measurements taken from the at least one measurement sub, the measurements being transmitted to the controller through the wired communication system; and control the drawwork to increase or reduce a weight-on-bit (WOB) of the drill bit based on the determined drilling parameters.

27 Claims, 10 Drawing Sheets

(56) References Cited

U.S. PATENT DOCUMENTS

| | | | | |
|---|---|---|---|---|
| 7,357,196 | B2 | 4/2008 | Goldman et al. | |
| 7,860,593 | B2 | 12/2010 | Boone | |
| 7,938,197 | B2 | 5/2011 | Boone et al. | |
| 8,121,971 | B2 | 2/2012 | Edwards et al. | |
| 8,215,417 | B2 | 7/2012 | Annaiyappa et al. | |
| 8,250,816 | B2 | 8/2012 | Donnally et al. | |
| 8,386,059 | B2 | 2/2013 | Boone | |
| 8,590,635 | B2 | 11/2013 | Koederitz | |
| 8,636,060 | B2 * | 1/2014 | Hernandez | E21B 47/12 166/250.01 |
| 8,718,802 | B2 | 5/2014 | Boone | |
| 9,027,671 | B2 | 5/2015 | Koederitz | |
| 9,121,962 | B2 * | 9/2015 | Madhavan | G01V 11/002 |
| 9,223,594 | B2 | 12/2015 | Brown et al. | |
| 9,285,794 | B2 | 3/2016 | Wang et al. | |
| 9,410,417 | B2 | 8/2016 | Reckmann et al. | |
| 9,429,009 | B2 | 8/2016 | Paulk et al. | |
| 9,436,173 | B2 | 9/2016 | Wang et al. | |
| 9,506,336 | B2 | 11/2016 | Orbell | |
| 9,528,364 | B2 | 12/2016 | Samuel et al. | |
| 9,593,567 | B2 | 3/2017 | Pink et al. | |
| 9,598,947 | B2 | 3/2017 | Wang et al. | |
| 9,784,089 | B2 | 10/2017 | Boone et al. | |
| 9,828,845 | B2 | 11/2017 | Kpetehoto et al. | |
| 9,896,925 | B2 | 2/2018 | Hernandez et al. | |
| 9,933,919 | B2 | 4/2018 | Raja et al. | |
| 9,934,338 | B2 | 4/2018 | Germain et al. | |
| 9,938,816 | B2 | 4/2018 | Astrid et al. | |
| 9,946,445 | B2 | 4/2018 | Whalley | |
| 9,959,022 | B2 | 5/2018 | Anghelescu et al. | |
| 9,988,880 | B2 | 6/2018 | Dykstra | |
| 9,995,129 | B2 | 6/2018 | Dykstra et al. | |
| 10,113,408 | B2 | 10/2018 | Pobedinski et al. | |
| 10,138,722 | B2 | 11/2018 | Magnuson | |
| 2005/0211470 | A1 * | 9/2005 | Jeffryes | E21B 44/00 175/27 |
| 2015/0369030 | A1 | 12/2015 | Hay et al. | |
| 2016/0024906 | A1 | 1/2016 | Jamison et al. | |
| 2017/0308802 | A1 | 10/2017 | Ramsoy et al. | |
| 2018/0156023 | A1 | 6/2018 | Dykstra et al. | |
| 2018/0298693 | A1 | 10/2018 | Van Duivendijk et al. | |
| 2018/0298694 | A1 | 10/2018 | Van Duivendijk et al. | |
| 2018/0328159 | A1 | 11/2018 | Mandava et al. | |
| 2018/0334887 | A1 | 11/2018 | Dashevskiy et al. | |

* cited by examiner

SYSTEM AND METHOD FOR DRILLING WEIGHT-ON-BIT BASED ON DISTRIBUTED INPUTS

BACKGROUND

Technical Field

For the exploration of oil and gas, wells are drilled, which connect the oil/gas reservoir to the surface. The well is drilled by a cutting tool such as a drill bit attached at the bottom of the drill string that is rotated by a rig at the surface. The drill string may include a plurality of pipe (i.e., the drill pipe) coupled end to end to be thousands of meters long. The lower part of the drill string is called the Bottom Hole Assembly (BHA) and consists of specialty tools and heavier thick-walled pipes, such as drill collars, including MWD and LWD tools and mud motors and/or rotary steerable systems (RSS). With the drill bit attached to the BHA, the drill bit is on the bottom of the wellbore, and the upper end of drill string is held by the rig. As such, most of the drill pipe portion of the drill string is therefore constantly in tension while the BHA is partly in compression. Furthermore, fluids are introduced into the wellbore by being pumped through the drill string and out through nozzles of the drill bit. From the drill bit, the fluids return to the surface via an annulus between the drill string and wellbore to transport cuttings from the bit to the surface and lubricate the drilling process.

The cutting action of the drill bit may be primarily controlled by weight-on-bit (WOB). For a given WOB and a given lithology of the well, the drill bit rotation requires a specific torque. In typical conditions, a higher WOB may result in a higher rate-of-penetration (ROP) up to a certain limit. The rig uses a drawwork to unspool a drilling line so that WOB is maintained slightly below the nominal value required to achieve the desired ROP. Furthermore, WOB and torque should be adequately controlled to avoid damage to the bit, while providing desired ROP.

In conventional drilling of a well, the drilling action of the drill-bit is commonly controlled by the unspooling line from the drawwork with objective to keep the WOB or eventually the ROP as steady as possible and the WOB just below a determined threshold. Furthermore, the WOB value is estimated, by the driller, to be equal to a difference between the hook load measurement when the drill string is off-bottom and the hook load measurement when drilling.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system to control a drilling of a wellbore that includes a drill string within the wellbore, wherein a wired communication system is along the drill string, at least one measurement sub configured to monitor at least one drilling parameter connected to the drill string and the at least one measurement sub being connected to the wired communication system; a drill bit at a distal end of the drill string; a drawwork mechanically coupled to the drill string and configured to lower the drill string attached thereto in the wellbore; a power controlling electronic connected to a motor of the drawwork, configured to control a drawwork unspooling speed; and a surface controller in communication with the power controlling electronic of the drawwork configured to: determine at least one drilling parameter along the drill string from measurements taken from the at least one measurement sub, the measurements being transmitted to the controller through the wired communication system; and control the drawwork to increase or reduce a weight-on-bit (WOB) of the drill bit based on the determined drilling parameters.

In another aspect, embodiments disclosed herein relate to a method to control a weight-on-bit (WOB) of a drill bit at a distal end of a drill string in a wellbore, that includes driving a drawwork, and the drill string attached thereto, with a controller; determining a drilling parameter from measurements taken by a wired communication system along the drill string and transmitted along the wired communication system to the controller; and adjusting the drive of the drawwork to increase or reduce the WOB of the drill bit based on the drilling parameter.

Other aspects and advantages of the claimed subject matter will be apparent from the following description and the appended claims.

DETAILED DESCRIPTION

Figure 1A:
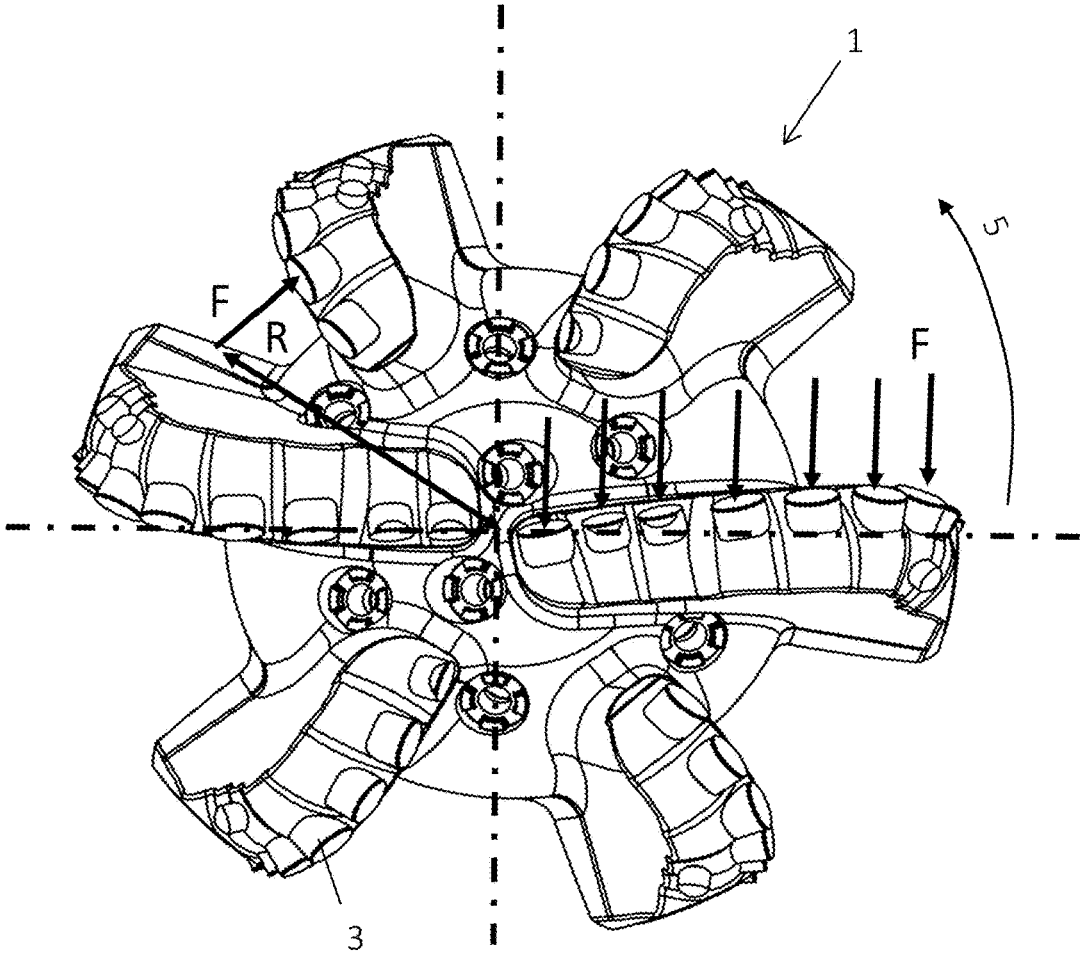
FIGS. 1A and 1B illustrate a drill bit according to an implementation of one or more embodiments of the present disclosure.

Embodiments of the present disclosure are described below in detail with reference to the accompanying figures. Like elements in the various figures may be denoted by like reference numerals for consistency. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description.

Further, embodiments disclosed herein are described with terms designating orientation in reference to a vertical wellbore, but any terms designating orientation should not be deemed to limit the scope of the disclosure. For example, embodiments of the disclosure may be made with reference to a horizontal wellbore. It is to be further understood that the various embodiments described herein may be used in various orientations, such as inclined, inverted, horizontal, vertical, etc., and in other environments, such as sub-sea, without departing from the scope of the present disclosure. The embodiments are described merely as examples of useful applications, which are not limited to any specific details of the embodiments herein.

In one aspect, embodiments disclosed herein relate to continuous measurements, along a drill string to arrive at axial force(s) along the drill string, and controlling drilling based on such distributed measurements along the drill string, which allows for optimization of the weight on bit (WOB). These types of measurements may be considered as drilling mechanic measurements. As mentioned above, in conventional drilling, the surface estimation of WOB value (SWOB) is estimated, by the driller, to be equal to a difference between the hook load measurement when the drill string is off-bottom and the hook load measurement when drilling. However, these measurements are taken from the surface, and as such friction effects along the well bore and axial inertia are not properly taken in account. In some applications, MWD and/or LWD systems have been equipped to measure the downhole WOB (called DWOB) and downhole torque (DTOR), as well as possess accelerometers to determine all unsteady movements near the drill bit: in some cases, axial and/or radial accelerometers may be used. The unsteady movement may be due to vibrations, shocks or acceleration due to change of speed of the BHA and bit, which can be axial, or rotational, or radial effects. When considering MWD/LWD applications, the update rate (of data) to the surface control system is low (once or twice per minutes), and the latency may be even slightly longer. With such limitations, the downhole WOB (DWOB) and downhole torque (DTOR) can only be used as average to determine the average friction along the well bore and allow slight corrections for the estimated surface WOB (SWOB) based on the hook load measurement.

However, embodiments of the present disclosure relate to the use of a wired communication system along the drill string involving wiring along the string, such as wired drill pipe, to provide a greater amount and faster transmission of data measured along the drill pipe so that the drilling mechanic measurements at the bit, and along the drill string may be available to determine the proper unspooling of the drawwork. As a communication method, wired drill pipe (WDP) provides a network technology along the drill string for fast data exchange along the drill string to the surface rig computer. The WDP allows two-way communication between multiple nodes in the drill string. Such notes may provide for real-time measurement in the well bore. For example, such measurement nodes may be by a drilling mechanics measurement sub (such as an OptiDrill sub offered by Schlumberger); however, it may be understood that any sensored device or measurement sub may be used to make the measurements along the drill string and serve as a "node" for the network and measurements. Additionally, a system interface connects said measurement subs to the WDP and thus to the surface rig computer.

Thus, systems and methods disclosed herein are directed to controlling a drilling process via drawwork unspooling rate based on various measurements performed at different positions along the drill string. By transmitting these measurements to the surface rig computer by wired drill pipe, the measurements are updated at a sufficient rate and with limited latency in relation to a rate of adapting the drawwork movement. In one or more embodiments, a system in accordance with aspects of the present disclosure includes usage of wired drill pipe associated with down-hole devices for measurement of downhole WOB (DWOB), downhole torque, and axial accelerations, for example, along the wired drill string. More specifically, implementations of the systems and methods can vary so that the rig surface computer may integrate multiple measurements versus depth and versus time (pre-calibration, and data matching versus time) into a control software which may include a model of the drilling system, based on real-time and low latency process, and the rig surface computer adapts continuously a setting of a drawwork controller or programmable-logic-controller (PLC). One skilled in the art will appreciate, upon reading the present disclosure, how systems and methods disclosed herein may result in the drilling process being performed with a higher rate-of-penetration (ROP) and longer bit run.

In accordance with aspects of the systems and methods disclosed herein, a cutting action of the drill bit may achieve higher ROP and/or a longer bit run, by using a combination of measurements along the drill string (or wired drill string) for optimum control of the drawwork. All the measurements taken along the drill string may be considered with surface hookload and hook-position (drawwork encoder) and used by a model running in the surface computer so that the optimum control parameter for drawwork unspooling may be determined. The surface computer then updates the drawwork controller or PLC. Additionally, the surface interface of the wired drill pipe is connected to the rig surface computer for proper data exchange with minimum latency. In the rig surface computer, a real-time software (involving drill string model and history data) may allow for the integration of all available measurements acquired along the wired drill string to output the best setting to the drawwork. In one or more embodiments, the setting of the top-drive or rotary table may also tuned to optimize the drilling efficiency.

Figure 1B:
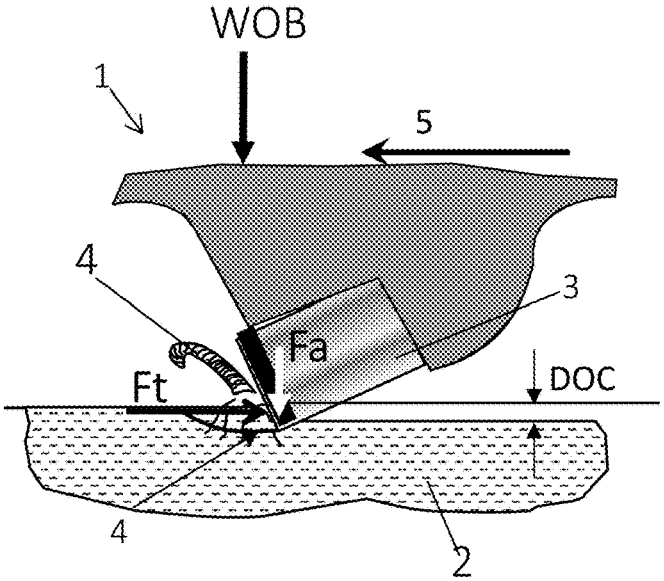

As shown in FIGS. 1A and 1B, systems and methods consistent with those disclosed herein may relate to a drill bit 1 having cutters 3 thereon that are used to cut rock. An axial force (see arrow Fa) is applied on each cutter due to a weight-on-bit (WOB) (see arrow WOB). The WOB engages cutters 3 of the drill bit 1 into the rock 2, allowing the cutters 3 to "crack" the rock 2 in chips (i.e., cutting). For proper cutting action, the cutters 3 must stay engaged with rock 2. The axial force Fa must be applied on each cutter 3, otherwise, the cutters 3 would be pushed backwards due to the back-rake of the cutter 3. Furthermore, due to the cutter back-rake, a cutting ejection 4 process may create a vertical lift force which must be compensated. Further, the sum of these forces (Fa) per cutter 3 is the required WOB to cut the rock 2. As illustrated, drill bit 1 is a fixed cutter bit, and the cutters 3 of the drill bit 1 are PDC cutters, but the present disclosure is not so limited (however, if another bit or cutter type is used, the skilled person would understand that the mode of cutting may vary, but the same principles disclosed herein may still apply). The PDC cutters 3 cut by shearing 4 the rock 2, and a resistance to shear of the rock generates an external tangential force (see arrow Ft) on each cutter 3. The external tangential force Ft is equivalent to a torque per cutter (Ft*R). The sum of all individual torques per cutter 3 is the required drive torque for the drill bit 1. A depth-of-cut (DOC) is created from the drill bit 1 by the shearing 4 of the rock 2. The DOC is a thickness of rock 2 being removed by the cutters 3 as the bit rotates (in the direction of arrow 5). Further, the DOC may depend on Fa, which in turn is the WOB. A larger DOC means more rock 2 removal per turn 5 which creates a higher ROP for a given drill string RPM. Additionally, the DOC may also vary dependent on rock properties of the rock 2. For example, the DOC would increase when the rock 2 become weaker (i.e., lower rock strength USC) while WOB is constant.

Figure 2A:
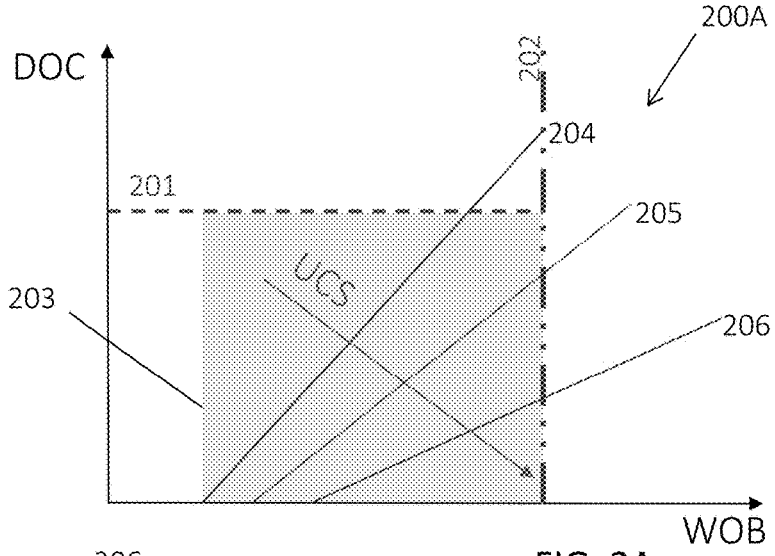
FIGS. 2A-2C illustrate graphs of theoretical cutting action of a drill bit according to one or more embodiments of the present disclosure.
Figure 2B:
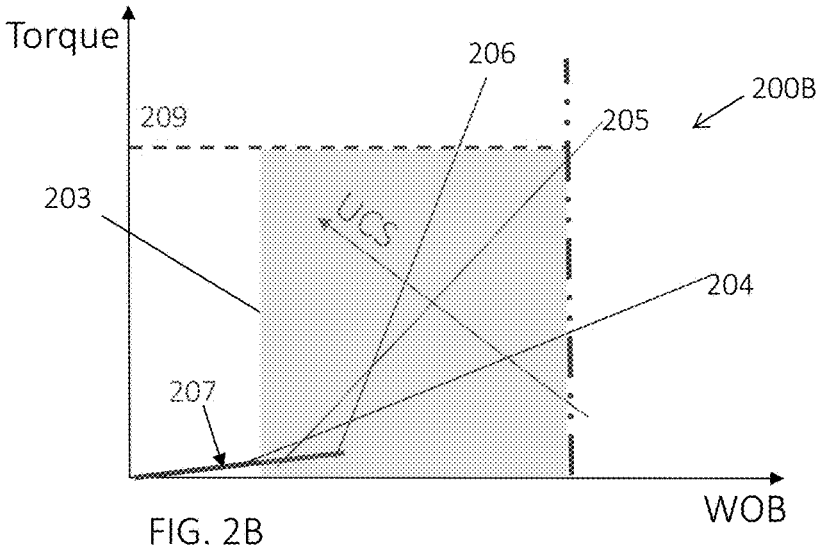
Figure 2C:
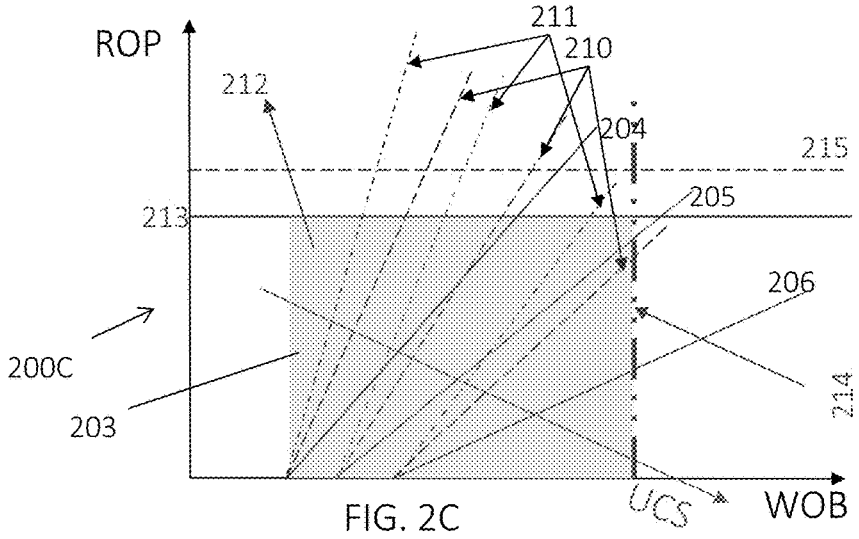

FIGS. 2A-2C illustrate graphs 200A, 200B, 200C of various drill bit performance parameters being plotted versus WOB having three different formation types (lines 204, 205, 206) with differing unconfined compressive strength (see arrow USC). FIG. 2A shows the graph 200A illustrating the relation between depth of cut for the cutter (DOC) (Y-axis) and WOB (X-axis), including also the effect rock strength. Additionally, the graph 200A includes a box 203 to represent various thresholds to engage the cutters of the drill bit into the rock. At too low WOB (the far left boundary of box 203), no cutting is achieved. Further, the graph 200A also indicates a dashed-dotted line 202 and a dashed line 201 to represent operation limits of a maximum acceptable WOB to avoid cutter failure in compression and a maximum applicable DOC to insure no contact between the bit blades and the wellbore bottom, respectively. FIG. 2B shows the graph 200B illustrating the relation between torque (Y-axis) and WOB (X-axis), including also the effect rock strength (see arrow USC). More specifically, at low WOB value, the cutters do not penetrate the rock and the torque is only generated by friction (and not by rock shearing), as shown by line 207. Additionally, the graph 200B also indicates operation limits of a maximum acceptable WOB at which the cutter may fail in compression (see dashed-dotted line 208) and a maximum acceptable torque to avoid cutter failure by shear force (see dashed line 209). FIG. 2C shows the graph 200B illustrating the relation between ROP (Y-axis) and WOB (X-axis), including also the effect rock strength (see arrow USC), as well as multiple RPMs. As shown in FIG. 2C, by increasing the bit RPM (dashed line 210 is the RPM for 204, 205, 206 multiplied by two and dashed-dotted line 211 is the RPM multiplied by three), the bit removes more rocks per unit of time, and so the ROP increased linearly with RPM. Furthermore, there is limit in ROP (see solid line 213) due to the amount of cutting generated in front of the bit face being in excess (i.e. bit cleaning limit). Additionally, the graph 200B also indicates operation limits of a maximum acceptable WOB at which the cutter may fail in compression (see dashed-dotted line 214) and a maximum acceptable ROP to avoid cutter failure by shear force (see dashed line 215). For operational purposes, the drill bit parameters should be operated within the range of acceptable operating conditions, as shown in box 203 of graphs 200A-C. Based on graphs 200A-C, drill bit behavior in real operation associates an increased ROP with an increase to WOB and RPM.

In conventional drilling methods, drill bit RPM is kept nearly steady. Further, surface WOB is tentatively kept constant even when ROP changes due to variations in the wellbore (i.e. variation of rock strength at the bit face). Additionally, in conventional drilling, the surface controller ("automatic driller") is often targeting a constant surface WOB independent of ROP. Conventional methods further relay on the driller to insure that the drilling operation is performed with all the limits described FIGS. 2A-2C. In conventional drilling operation, the drilling control (manual or automated) is based on surface real-time measurements and this limits the accuracy of the determination of the drill bit operations conditions. However, in one or more embodiments, systems and methods disclosed herein are directed the control of the drill bit operation based on determined control parameters obtained at multiples points along the wired drill string and may be automated.

Figure 3:
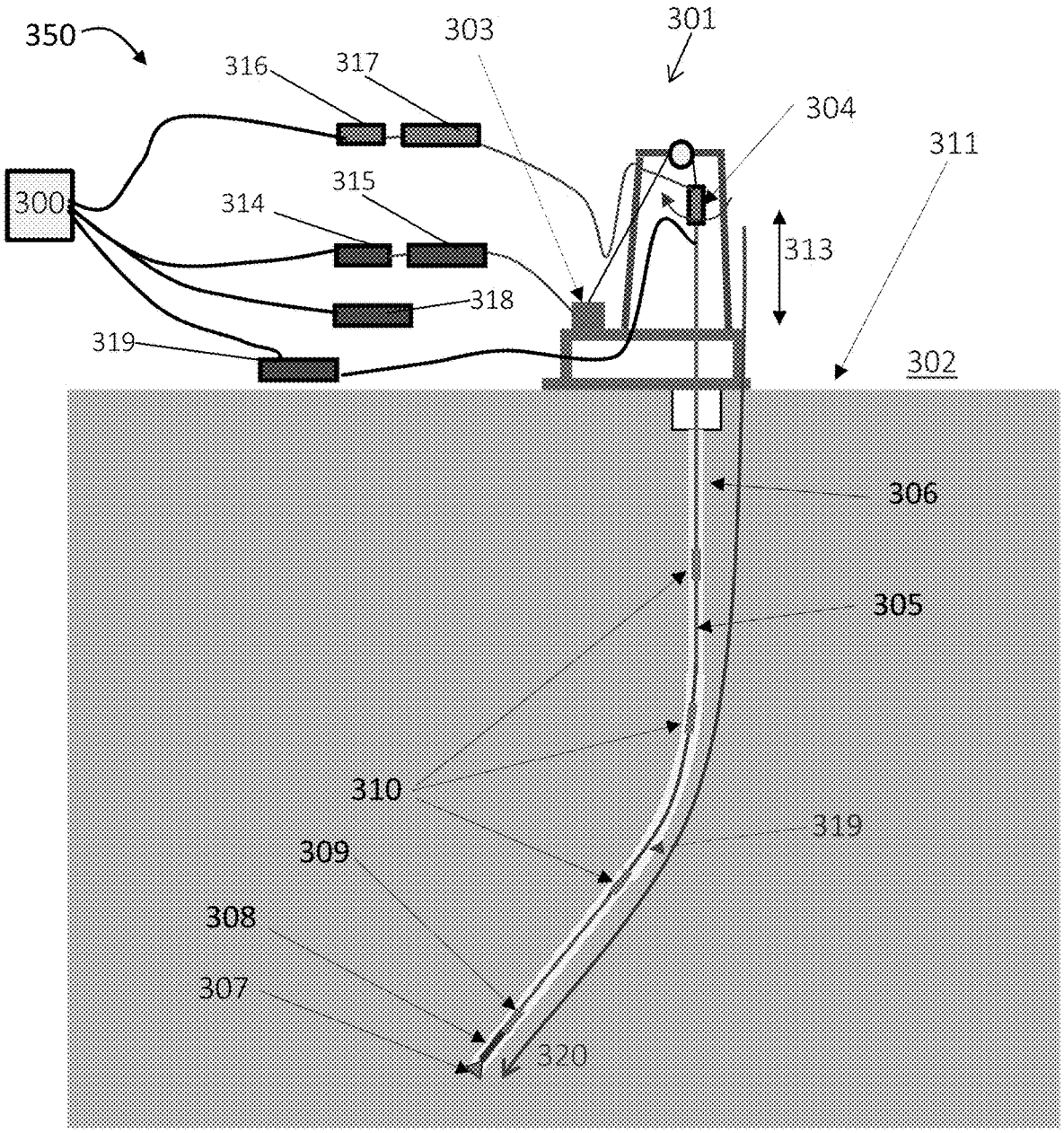
FIG. 3 illustrates a functional schematic diagram illustrating an example of a rig control system according to one or more embodiments of the present disclosure.

Now referring to FIG. 3, FIG. 3 illustrates drilling operation 350 in accordance with embodiments of the present disclosure. Drilling operation includes a rig control system 300 for a drilling rig 301 on a well site 302. The drilling rig 301 includes a drawwork 303 with a line connected to a top drive 304 to suspend a drill string 305 in a wellbore 306. In some cases, the wellbore 306 may be vertical in part and also include a curved portion where well bore axial fiction occurs. It is also understood that the wellbore 306 may also include a horizontal section. The drawwork 303 includes a drawwork PLC or controller 314 and a VFD 315 for drawwwork motor (not shown) installed on the drawwork 303 in communication with the rig control system 300 to control an unspooling of a drawwork line controlling a hook load for the WOB. The VFD 315 of the drawwork 303 is equipped with a brake resistor and electronic chopper. When lowering the drill string, the motor of the drawwork acts as a generator: the generated electric power is dissipated in the brake resistor by the control power feeding by the chopper, so that the unspooling speed corresponds to the setting imposed by the rig controller 300. Further, the top drive 304 communicates to the rig control system 300 through a top drive PLC or controller 316 and a VFD 317 for top drive motor (not shown) installed on the top-drive 304. The rig control system 300 may also include a rig sensor PLC 318 for detecting one or more measurements at the surface. The drill string may include wired drill pipe connected end to end to form wired drill string 305, the data transmitted by which is sent to the rig control system 300 via a surface network interface 319. Additionally, a drill bit 307 is attached at a distal end of the wired drill string 305. The wired drill string 305 may further include at least one downhole measurement sub 308 to take downhole measurements. Specifically, the downhole measurement sub 308 allows for the measurement of downhole WOB, downhole torque, and axial acceleration. Additionally, the downhole measurement sub 308 is in communication with the wired drill pipe 305 via a wired drill pipe interface 309. In some embodiment, the sub 308 may be directly connected to the wired-drill-pipe system. One skilled in the art will appreciate how these measurements are transmitted up-hole with low latency telemetry and at high sampling rate thanks to high data rate. It is further envisioned that drill string my not be wired and use other forms of communication. The wired drill string 305 may have multiple data network node subs 310 at specific distance. For example purposes only, the data network node subs 310 may be every 500 meters along the wired drill string 305. The data network node subs 310 decode and re-encode the communication signal to insure telemetry signal amplitude boosting. The data network node subs 310 may also add data (i.e. the node specific measurement and status) in a network exchange. Further, in one or more embodiments, the node subs 310 may be instrumented (i.e., provided with measurement sensors) so that additional measurements may be taken along the drill string, including drilling mechanic measurements based on accelerometers to determine shock or vibration or strain gauges or any other sensors for force and torque measurements. Further, it is also envisioned that such sensors may be pleased in subs separate and distinct from the network nodes.

At a surface 311 of the rig site 302, a wired drill pipe interface system 319, which may be installed in the drilling control room, is a main interface network node and allows communication between the wired drill string 305 and the rig control system 300. The combination of and the wired drill pipe 305 may allow for high quantity of information being exchange in a short time and with minimum latency. A non-limiting example of the speed of communication is 50 Kbit/S. The rig control system 300 receives the downhole measurements (such as but not limited to downhole WOB, downhole torque, accelerations, etc.) and data from the wired drill pipe interface system 319. Rig control system 300 may also receive surface measurements (e.g., surface WOB, surface torque, Top drive elevation 313, drawwork encoder data) for example from rig sensor PLC 318. Rig control system 300 may also receive data by variable frequency drive (VFD) 315 and 317 to drive rig machines 303, 304. Surface data may include surface WOB, surface torque, top drive elevation, drawwork encoder data, for example. It is understood that some of this information may be provided by a VFD which drives a machine, such as the surface torque deduced from the current output of a VFD driving the top drive. Thus, in accordance with embodiments of the present disclosure, the rig control system 300 supports the real-time processing of both downhole and surface data to determine optimum control of the drawwork 303, and the unspooling rate of the drawwork, which in turn to impacts WOB so that may be WOB may be controlled, albeit indirectly by the unspooling rate.

Figure 4:
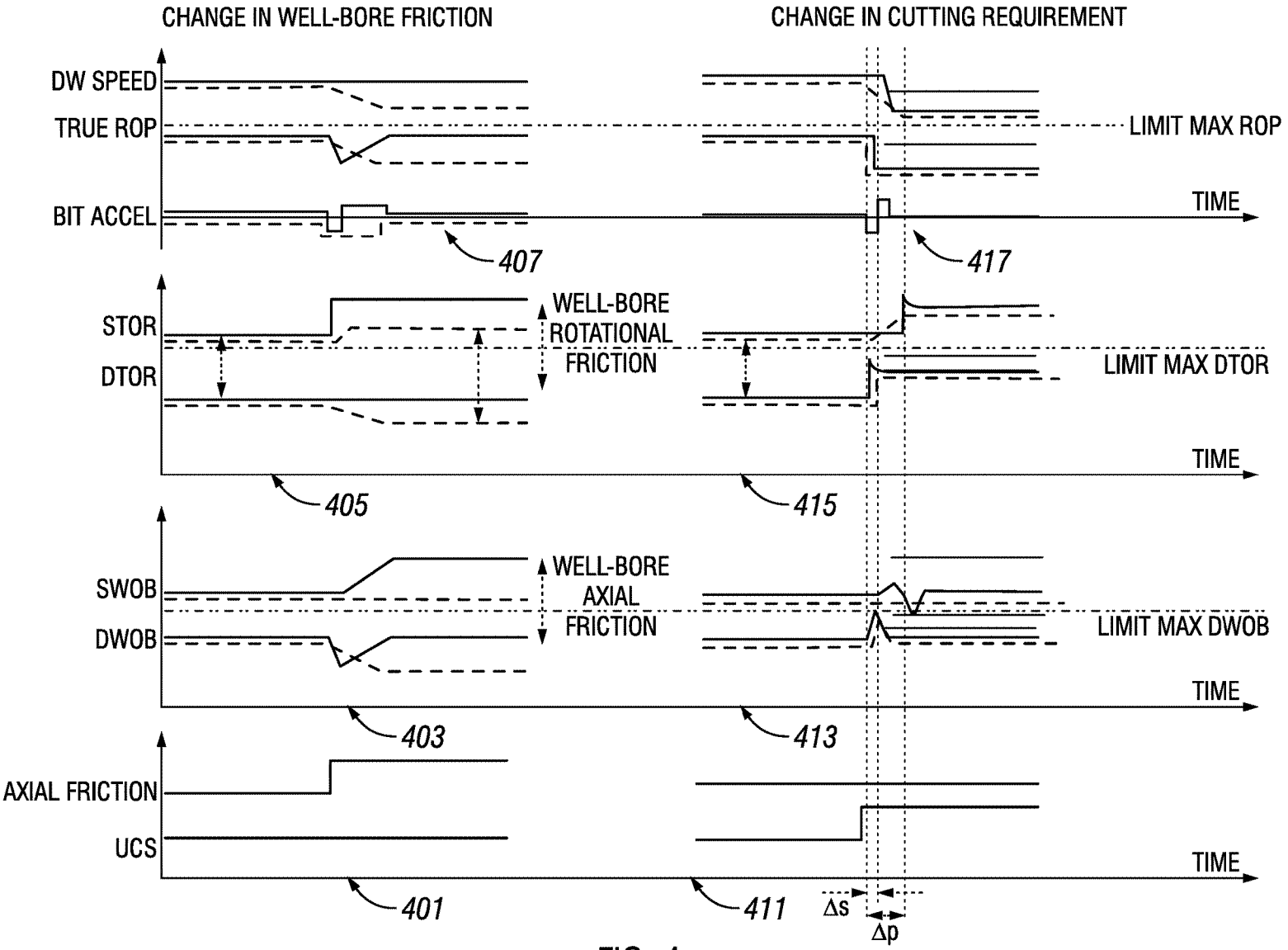
FIG. 4 illustrates a graph of reference function of a step change in drill conditions according to one or more embodiments of the present disclosure.

Referring now to FIG. 4, FIG. 4 shows the behavior of the drilling system in a common operation mode and demonstrates the benefit of the present system for real bit engagement with the rock, for changes in friction and changes in rock properties at the bit face. Graphs 401 and 411 show changes in wellbore friction and rock properties, respectively. In each of the graphs 403, 405, 407, 413, 415, and 417, the dotted line represents changes what would occur by conventional drilling operations when the changes in 401 and 411 are experienced, whereas the solid line represents control of the unspooling rate based on downhole measurements, in accordance with embodiments of the present disclosure, based on the changes experienced in 401 and 411. For example, when there is an increased in the amount of axial friction (shown in 401), as shown in 403, no detection in the surface WOB would occur in conventional operations, whereas a decrease in the downhole WOB would be experienced. Thus, the axial friction in the wellbore creates an offset between the SWOB and DWOB. In conventional drilling, this offset may be determined by raising the bit off-bottom and moving the drill string upwards and downwards, while monitoring the difference in hookload (equal to twice the friction effect). Then this "estimated friction" may be taken in account to estimate the SWOB from hookload while drilling. Such estimation is only performed periodically: it will not be done continuously. ROP would drop if it is not detected while drilling as shown in 407.

Further, as shown in 405, there would also be a decrease in the downhole torque and a slight increase in the surface torque. Last, as shown in 407, the ROP would decrease. However, in accordance with one or more embodiments of the present disclosure, by detecting changes in downhole WOB, downhole torque, bit acceleration, drawwork speed, surface torque, the drawwork speed may be controlled (in 407) so as to correct the downhole WOB (DWOB) (showing a temporary reduction in downhole WOB in 403), by increasing the surface WOB which in turn also restores the downhole torque (in 405). Further, due to the increased rotational friction, the surface torque increases. Ultimately, in accordance with the present embodiments, the ROP may be maintained (or increased relative to the conventional operations). Thus, with the methods and systems of the present disclosure, DWOB can be continuously measured and transmitted to in the control software of the rig control system for determining the instantaneous rate of unspooling the drill-line at the drawwork. Thus, ROP would not be affected by change of friction in the wellbore, after a possible short period of adaptation.

In 411, rather than a change in axial friction being experienced, a change in the rock properties is experienced, and graphs 413, 415, and 417 show the corresponding changes in the drilling conditions according to conventional methods and methods of the present disclosure. Changes in rock properties would normally affect the ROP. When operating according to conventional methodology, it is not possible to differentiate between such change in rock properties and the effect of change in wellbore friction. As SWOB is kept constant, ROP drops. However, in accordance with the present embodiments, by observing the increase in downhole torque (shown in 415), it is possible to detect the change in cutting requirement (shown in 411). Thus, SWOB can be increased while keeping proper considerations to maximum WOB and torque for the bit (to avoid reaching the operational limits of the bit). As further shown by FIG. 4, the true ROP would drop in a similar way independent of the downhole measurements. However, thanks to downhole measurements sent to surface via WDP, it is further envisioned that system may be able to deduce that the reduction of ROP for sustained DWOB is due to an increase of rock strength. Furthermore, the drilling torque is also increased. The control system 300 may increase SWOB and DWOB while insuring that DWOB is below the critical upper value to avoid damage to the drill-bit.

Still referring to FIG. 4, a delay $\Delta S$ corresponds to the response of the drilling effect to the fact that the bit is cutting harder rock. Additionally, a delay $\Delta P$ corresponds to the transmission of the change of SWOB from the top of the drill string to the bit, as a corresponding acoustic wave is required for the travel of this increase of loading through the drill string.

Figure 5:
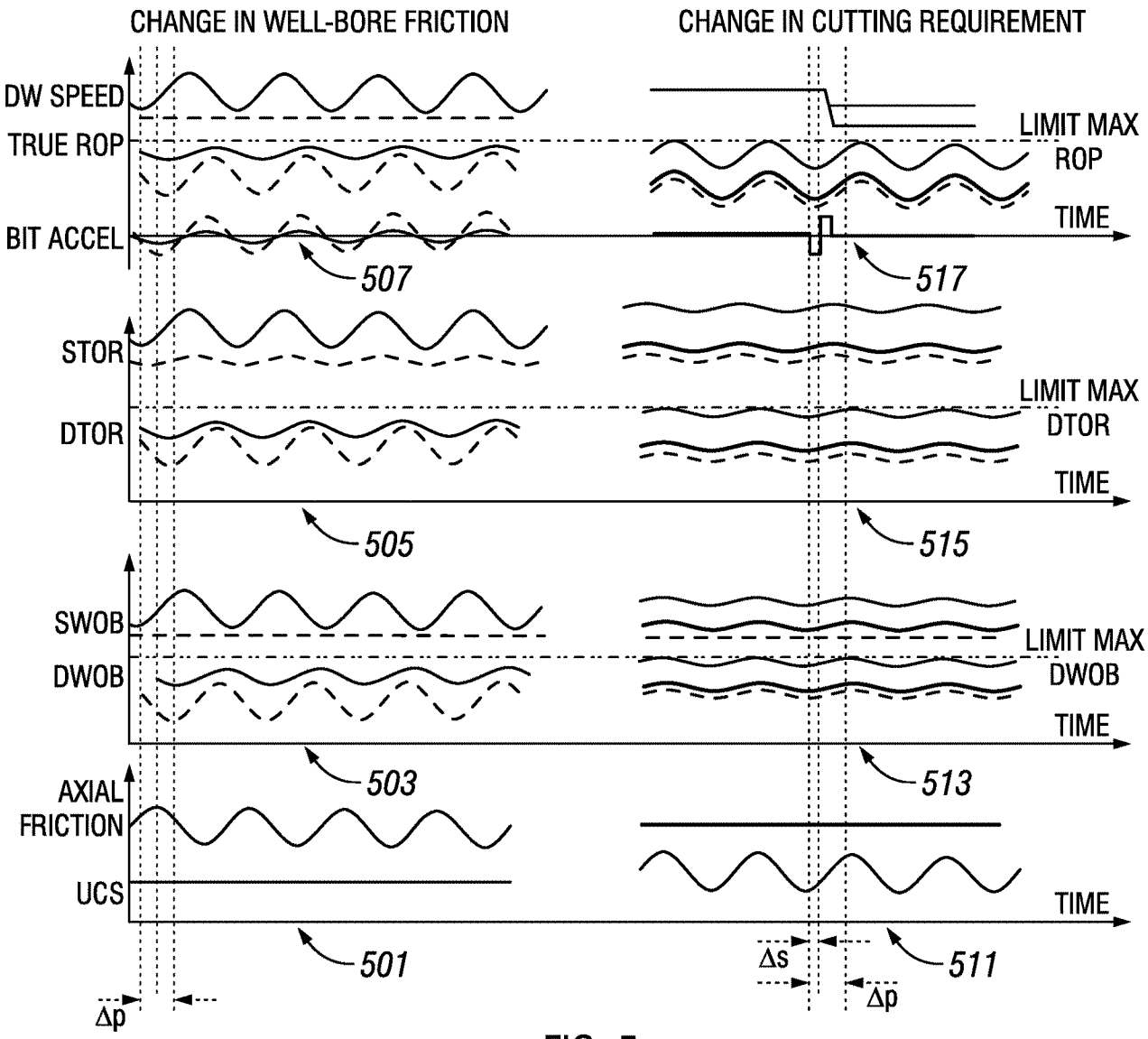
FIG. 5 illustrates a graph of reference function of a repetitive change in drill conditions according to one or more embodiments of the present disclosure.

Referring now to FIG. 5, FIG. 5 shows effects of repetitive changes in axial friction and rock properties, and the resulting effect in the drilling conditions that result from such changes. Such repetitive changes may result, for example, when there is a repetitive stabilizer hanging in the wellbore (in the case of repetitive axial friction changes) or when the drill bit passes through a succession of alternating thin layers or laminates of differing rock or agglomerates of hard rock embedded within soft rock (for repetitive changes in rock properties). In such situation, the behavior of all data is an oscillation (sine effect). Further, similar to FIG. 4, in conventional methods, the ROP is lowered based on the lack of downhole measurements (or control based on such downhole measurements). However, in accordance with the presently described embodiments, a higher ROP may be achieved (shown in 507 and 517) when the downhole WOB and torque changes are detected and considered relative to the surface measurements. The present embodiments may allow for the recognition of the source of the issue (friction or rock change). Further, the present embodiments allow for the drilling control system to push the drilling operation closer to the limits of the equipment (shown in 513, 515, and 517). In some case, operating near the operational limits is the approach taken to ensure high ROP. Specifically, with particular attention to 511, 513, 515 and 517 in FIG. 5, with repetitive changes in the rock properties, it may be better to operate at the WOB limits to see an effect in the ROP; however, to do so, it will be necessary to know what is being experienced downhole (in terms of the variation in the downhole WOB). From a learning perspective, the drilling control system may focus on ensuring that the peaks of the conditions are less than the operational limits so that the drawwork speed can be set to ensure that the operation is performed within such limits.

As illustrated, all the elements are quite linear, even if some delays may exist due to the transmission of changes along the drill string. For example, a sudden change of SWOB appears as an axial wave which propagates downwards at a velocity which may be considered as the P-wave velocity in steel. Further, it may also be understood that the downhole and surface measurements may be out of phase due to wave transmission.

Further, when there is a repetitive change in conditions in particular, shown for example in 501 or 511 of FIG. 5, in accordance with one or more embodiments of the present disclosure, prior to implementing changes in the drawwork speed (to control WOB), there may be a learning phase in relation to the downhole oscillations being experienced so that appropriate proactive compensation changes may be determined. For example, initially, the drilling control system may, based on the measurements collected, determine if the changes are due to rock changes or friction changes. When the there is an increase in the axial friction, and the drawwork is operating at a constant speed, the downhole WOB will decrease. In contrast, when there is a decrease in friction, and the drawwork is operating at a constant speed, there is an increase in downhole WOB. When the bit encounters a harder rock, there will be a compression in the drill string (seen in the hook load with some delay), and the downhole WOB will increase. In contrast, when the bit encounters a softer rock, the drillstring will extend due to faster drilling, showing a reduced downhole WOB, but increased hookload at the surface (or surface WOB). Thus, be considering both the effect at the bit and the surface, the changes between friction and rock properties may be discerned, and the control of the drawwork rate may be modified appropriately Further, as mentioned, there is generally a delay due to wave transmissions within the system that will be incorporated into the proactive compensations. However, as shown, by varying the surface WOB (by changing the drawwork speed), the ROP that is achieved may be greater (and in the case of changes in friction, the ROP may be smoother).

Referring now to FIGS. 6A-6C, FIG. 6 shows a drill string model that involves non-linear conditions, specifically elastic deformation and dampening in the system 600. In this illustration, drillstring and downhole components are grouped together to represent the downhole system. For simplification, only three sections (601, 603, and 605) are shown; however, it is understood that the drill string may be divided into a number more section to provide a more realistic representation. In the vertical section 601, there is some elastic deformation (elongation) in the drill string, but low friction. The curved section 603 is associated with friction which drastically depends on the slippage speed, and obviously a friction threshold to start the slippage. Such situation would often be present: when no rotation is present (such as sliding drilling with a motor); when hanging occurs at some stabilizers; when tubular connections hang in keyseat; when cutting beds are unstable; when there is whirling at the BHA, causing friction depending on RPM; the axial friction factor is affected by the rotation (RPM), as the total slippage velocity is depending on RPM; or the friction at the wall is affected by well-bore overbalance (in a managed pressure drilling scenario). Other non-linearity effects may be related to: non-linear deformation (such as buckling), which makes the elastic behavior of the system not linear and may drastically induce friction with the well-bore; non-linear relation between downhole torque and downhole WOB at the bit; non-linear relation between downhole WOB and ROP. The difference in the μ for each section 601, 603, 605 is shown. In 605, for example, in the horizontal section, the well annular cross-section is often full of cuttings, which increase the friction substantially, but as shown in $\mu_{605}$, the friction reduces substantially as the cuttings are remixed.

Based on the differences conditions in the different sections of the wellbore shown in 600, it may be understood that drilling control system 300 may use different models that correlate to the different drill string sections. Further, placement of measurement nodes along the drill string may be based on a planned wellbore and recognition that utilization of these different models may involve data measured from each section. Thus, distribution of measurement subs along the drill string may allow for a more accurate reflection of the downhole conditions.

In presence of non-linear behavior(s) along the well-bore, the detected behavior (at the surface) of the drill string may not be easily related to the drill bit cutting actions. A stable downhole DWOB value is the objective, but the drawwork unspooling speed is the element to be controlled. Considering that RPM and mud flow conditions are kept constant, the drillabilty function can be determined: Bit ROP=Function (DWOB, UCS). The "drill string_transfer" function of the drill string can be considered: DWOB(t)−SWOB(t)=Funct1 (friction, inertial effect, DS_elong), DWOB(t)−SWOB(t)=Funct2 (slippage velocity, accel, elong), and DWOB(t)−SWOB(t)~Funct3 [ROP, DW_speed, δROP/δt, δDW_speed/δt, ∫(ROP-DW_speed) δt]. ROP at the bit can be estimated form the knowledge of DW_speed and bit_Accel:

$$\text{Bit ROP}(t)=\int \text{DW-speed}(t-T_{trans})\delta t/\Delta t+\int \text{bit_Accel}\,\delta t$$

Where Δt is the time since the last time of zero bit_Accel; and $T_{trans}$ is the transmission time form surface to bit of change (P-wave transmission time).

The "drill string transfer" function [DWOB(t)−SWOB(t)] includes the effect of the friction at wall: this effect may be non-linear versus the slippage. In the real condition, this function is not known and UCS is not known. However, as shown in FIGS. 6B and 6C, different rock properties (or UCS) may have a different torque and ROP response as the WOB increases. It is understood that the different sections of the wellbore may be experiencing these variations in rock between (or within) the section.

Such function includes dependence on change of position, on axial velocity and acceleration. Such function can be characterized versus time and may display some oscillation behavior during adjustment when an excitation may be present such as step function (on UCS). Such conditions are represented versus space in FIG. 6A and versus time in FIG. 7.

Recording of downhole WOB (DWOB), surface WOB (SWOB), bit Accelerations, and drawwork speed allows for the approximation of the function. With the approximation of the "drill string transfer" function, two different usages may be done: (1) fast fourier transform of the "drill string transfer" function to determine the frequency response of that system. Based on this FFT, a "DW_filter" function can be determined. This function DW_filter is used to determine the desired drawwork speed to be applied by the drawwork VFD. (2) The initial drawwork speed response filtered (by time convolution) with DW-Filter to obtain the "filtered DW-speed").

The "drill string transfer" function can be used to tune a mathematical model of the drill string. After the tuning of the model on the recorded data, the tuned-model may be used to determine the optimum drive of the drawwork. This optimization corresponds to the "critical damping" operation of a resonant system. This is described in FIG. 7.

Figure 6A:
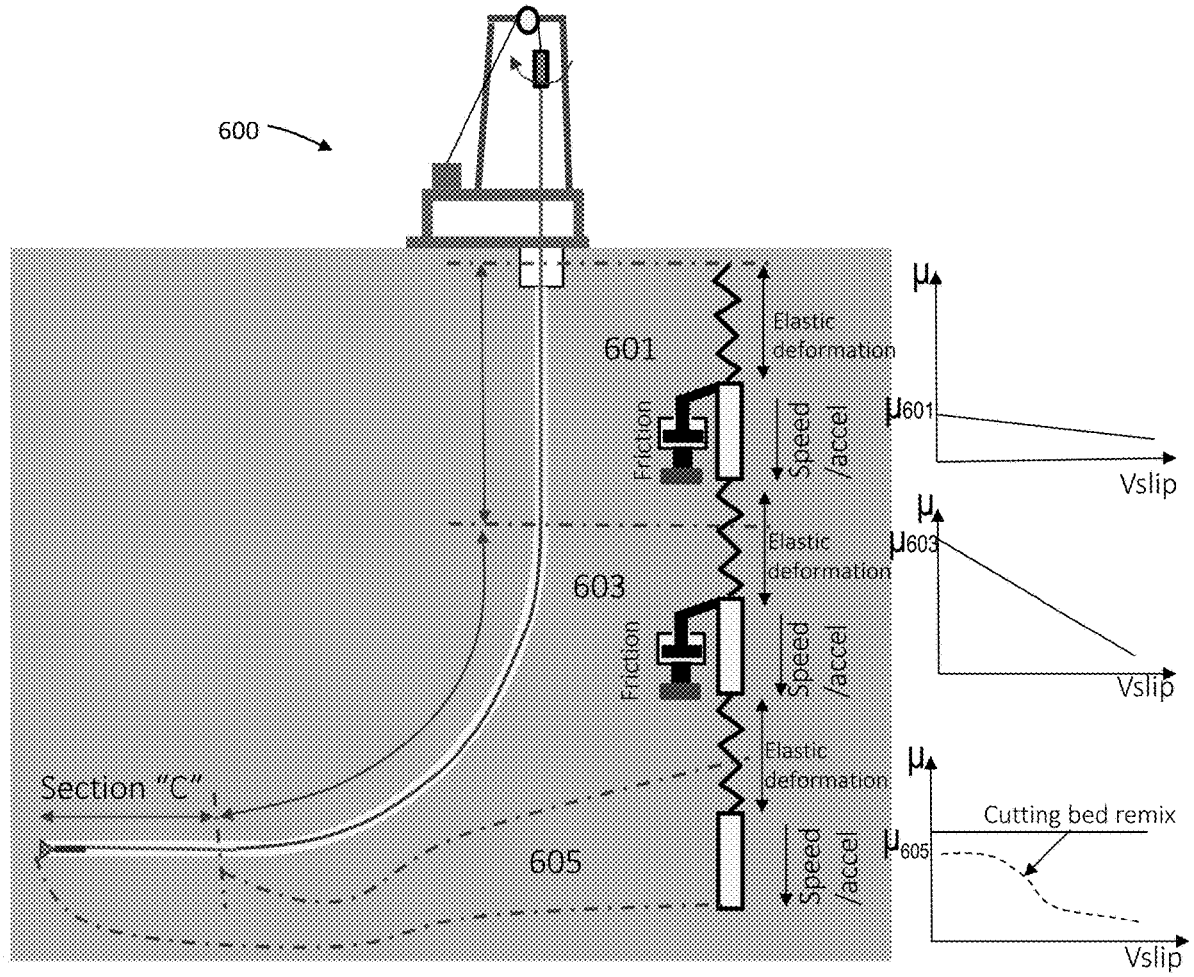
FIG. 6A illustrates a functional schematic diagram of an example drilling rig system according to one or more embodiments of the present disclosure.
Figure 6B:
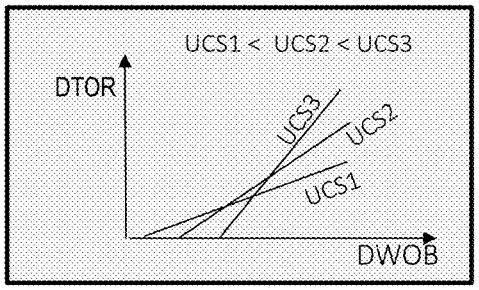
FIGS. 6B and 6C illustrate graphs of reference function of a change in drill conditions.
Figure 6C:
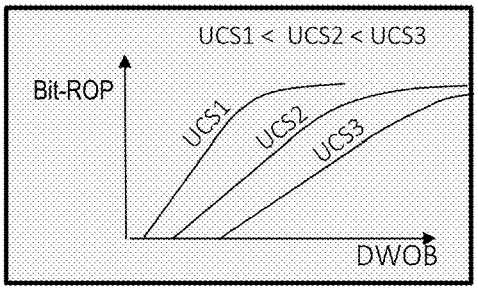

The drill string model may be based on lumped element as described in FIG. 6A (which may include a large amount of elements) or even based on finite element analysis. For example, it is understood that the IDEAS (offered by Schlumberger) model of the drill string may be incorporated into the above analysis.

Figure 7:
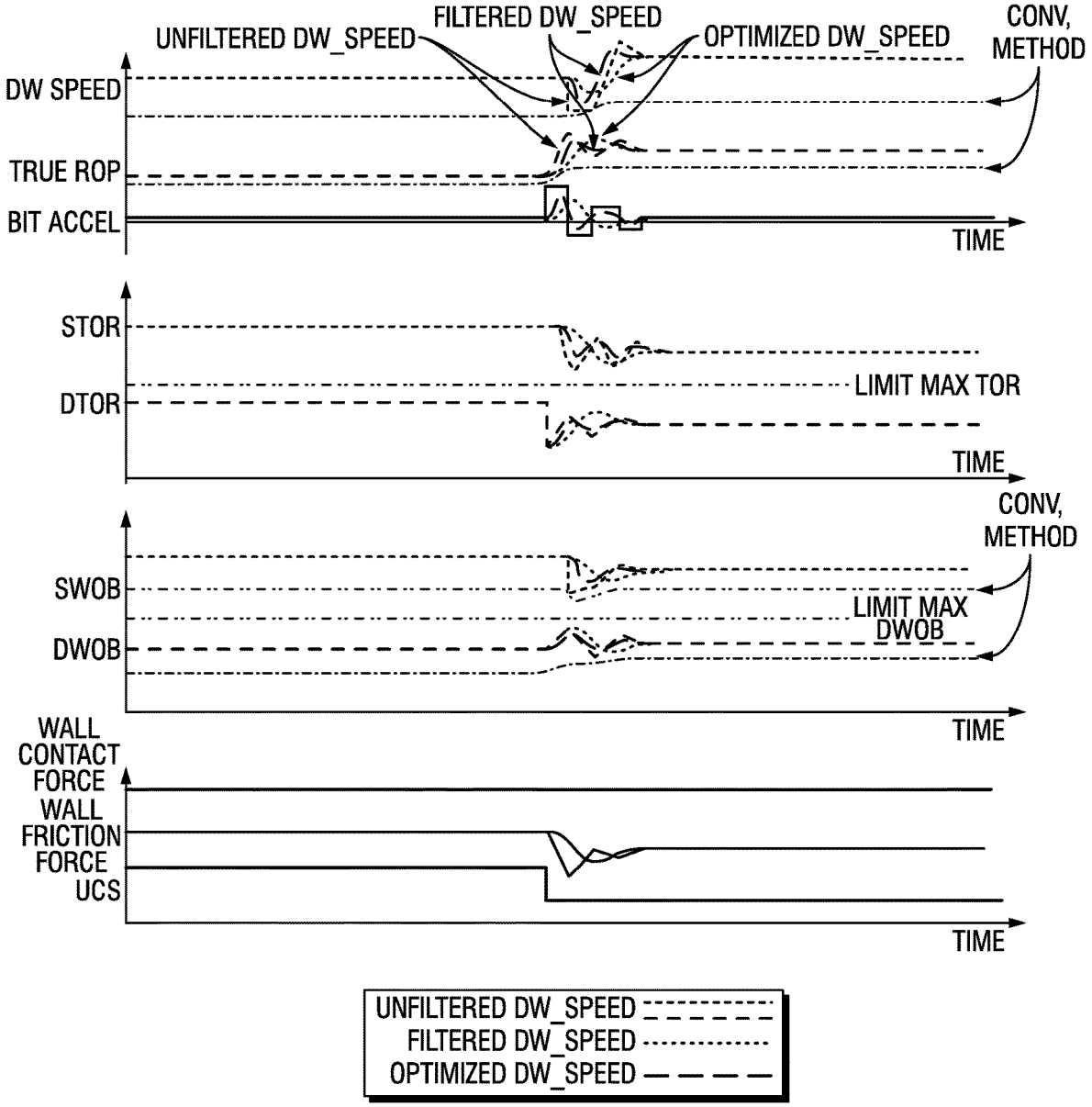
FIG. 7 illustrates a graph of reference function of a non-linear change in drill conditions according to one or more embodiments of the present disclosure.

Specifically focusing on FIG. 7, the usage of wired drill pipe and a down-hole measurement system allows the system to operate with the "unfiltered condition". Coupling "aggressive" changes in the setting of drawwork speed with "aggressive" changes in the bit drilling conditions may induce fatigue of the components (drill-bit, drill string, surface machine drawwork and top drive). In contrast, usage of a filtered DW_speed may minimize the aggressiveness of the changes on the drilling system (though, some oscillation may still be present). However, by using an optimized DW_speed, the oscillations are minimized. FIG. 7 also indicates that the drilling is faster when using a combination of down-hole and up-hole measurements. By better knowing of instantaneous downhole torque and downhole WOB, it may be possible to operate the drill bit closer to the limit and provide higher ROP without risking the life and safety of the various tools and equipment. Further, as mentioned above, it is envisioned that the system may learn with time how to find the optimum conditions (keeping in mind the thresholds described above) for optimum ROP, and the appropriate aggressiveness in the response so as to minimize resonance in the system.

Additionally, by managing the response to transient changes occurring during drilling, it is possible to avoid to cross these limits (for bit survival and duration) even during transient changes. In the case of FIG. 7, the oscillation on downhole WOB stays below the critical value. In the shown example, there is no issue in relation to oscillation to downhole torque (DTOR) (as UCS is step-down function); it would be more critical in the case of a step-up in UCS (as shown in FIG. 4).

Figure 8:
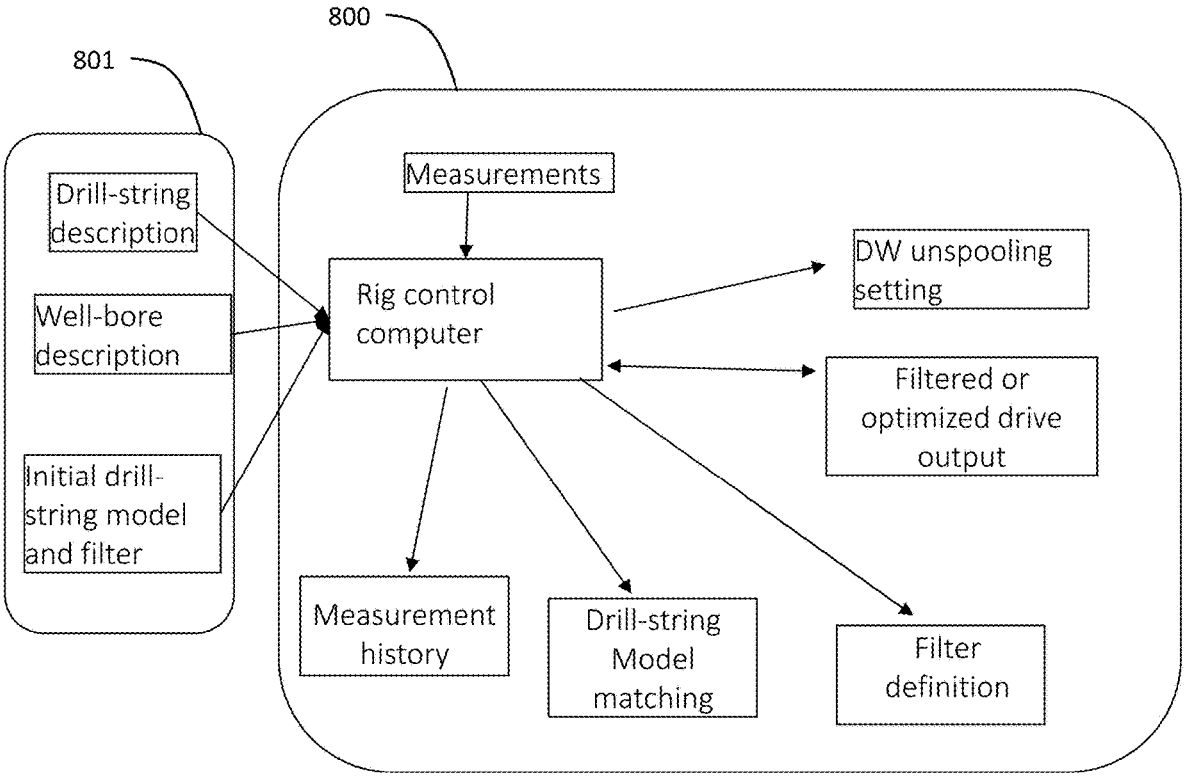
FIG. 8 illustrates a functional block diagram of a rig control system according to one or more embodiments of the present disclosure.

Referring now to FIG. 8, FIG. 8 describes the actions performed by the rig control system 800. Initial inputs 801 into the system include a drill string description (to determine the model), a wellbore description to allow the model to select a friction model, and an initial model of the drill string to define drill string transfer function (described above with reference to FIGS. 6-7). It is also envisioned that there may be other inputs.

During drilling, the control system 800 performs continuous actions during drilling that include consideration of measurements (at the surface and downhole via wired drill pipe and downhole subs); updating the time data base of the measurements; matching (tuning) of the drill string model and the drill string transfer function based on the measurements; determination of the filter (slow tuning); determination of the filtered or optimized drive output for the drawwork; and application of the filtered or optimized drive output on the drawwork. Further, it should be noted that the drill string model and the "drill string transfer" function may be improved by additional measurements of axial acceleration along the drill string. Thus, it is envisioned that the multiple measurements may be made along the drill string, as discussed above. Further, it is also envisioned that the measurement sub proximate the bit (or BHA) may have a greater number of measurement sensors than distributed along the drill string. For example, a sub proximate the bit may include strain gages, accelerometers, magnetometers etc., whereas other measurement nodes may include only accelerometers and/or magnetometers.

Figure 9:
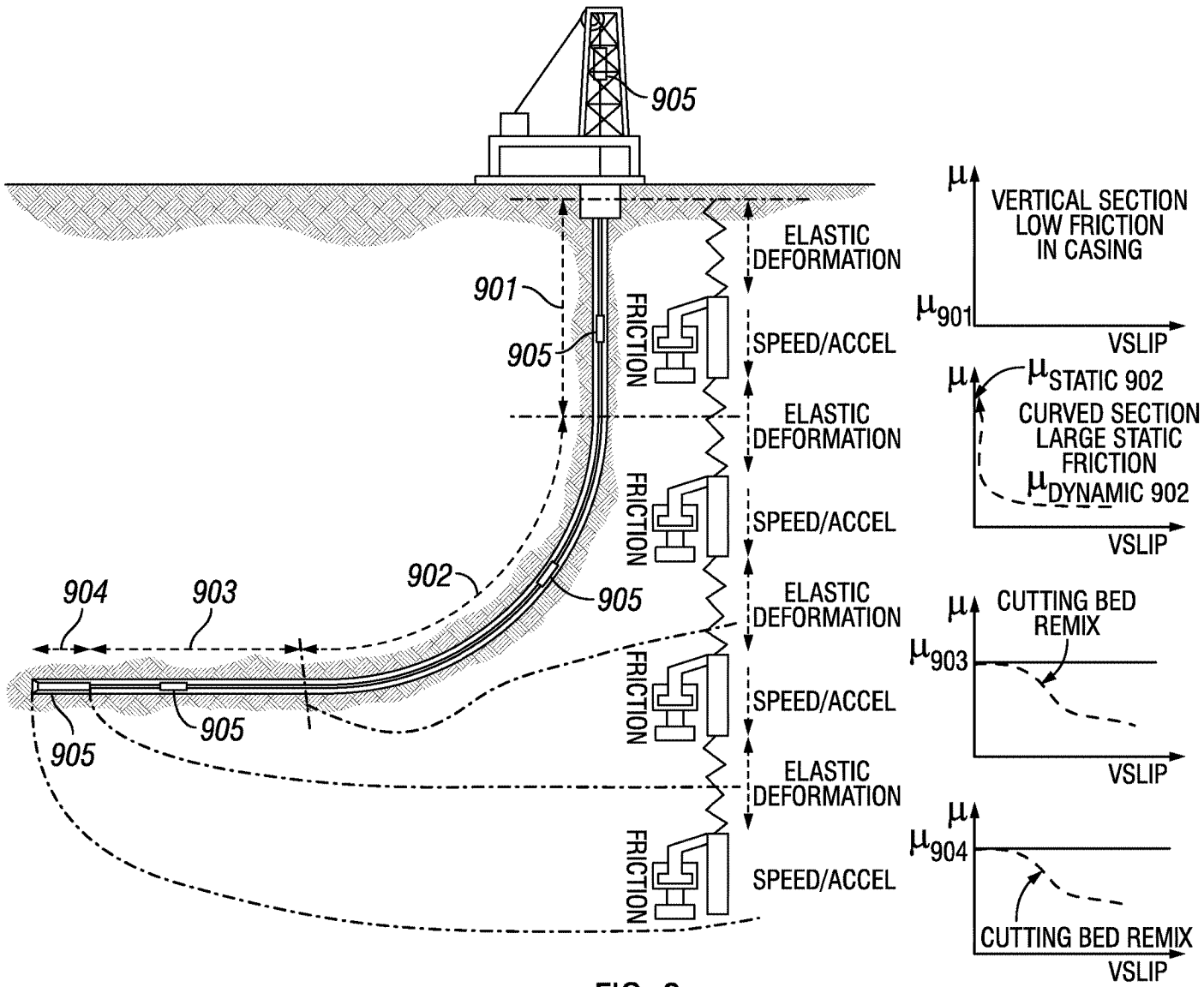
FIG. 9 illustrates a functional schematic diagram of a drilling rig system according to one or more embodiments of the present disclosure.
Figure 10:
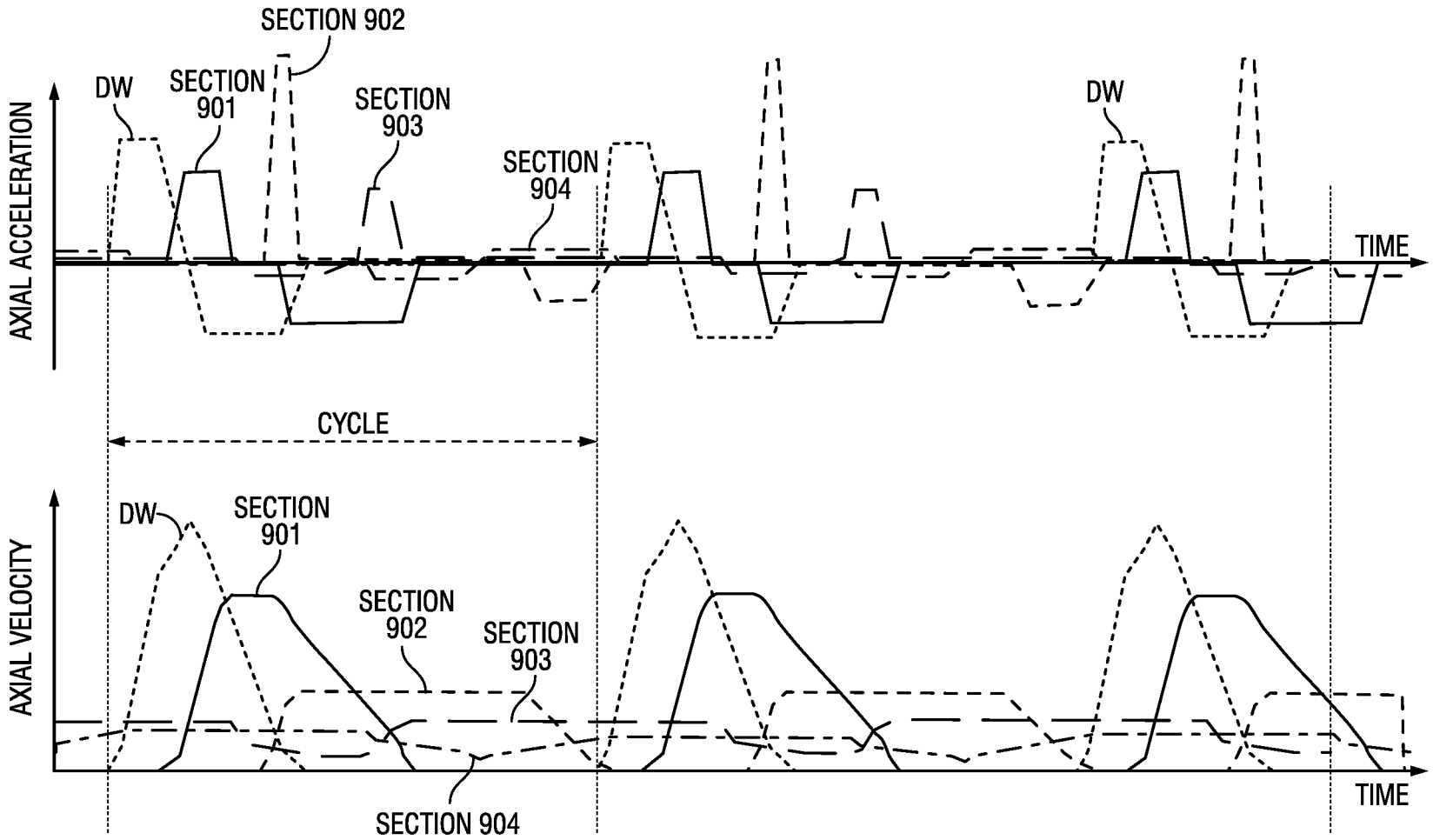
FIG. 10 illustrates a graph of reference function of an axial sticking management in a drill string.

Referring now to FIGS. 9 and 10, the figures describes potential usage of such distributed information along the drill string. For example, as mentioned above, the friction along the wall of the wellbore may depend on the section of the well. In FIG. 9, section 901 is the cased vertical section. The friction factor ($\mu_{901}$) may be low as the drill string is in a cased hole. Also, the side force is minimum as that section is vertical. Section 902 is the curve (or the tangent section). This section may be partially "open-hole" over the lower part. In such section, the friction may be higher. In such section static friction coefficient may be high as the string is pushed side-away by the well curvature or even by gravity: the lubrication film may not be existent is such condition. So $\mu_{Static}$ is high. Furthermore, key seat may be present so that local contact force can be important (especially on the tool-joints). As soon as movement is imposed, the lubrication may be reinitialized and the contact in the key-seat may become loose: this means that the dynamic friction factor $\mu_{Dynamic}$ may be lower. In section 902, heavy weight tubulars may be used to create axial force on the lower part of the drill string.

Section 903 represents the horizontal section. This section may be long so that it represents a large mass. It typically set in compression. The friction to the wall is strongly affected by the presence of cutting beds. Such cuttings typically create high friction; however, with some specific drilling parameters, the cutting bed may be reduced or nearly suppressed (high string RPM, high flow rate, high mud viscosity).

Section 904 is the BHA. This is characterized by large rigid tubular with low elastic deformation. The friction to the wall may be high, as the annulus is small and the cutting bed may be large. Also, stabilizers may create difficulty to move (hanging on the corner of the blades). Finally, whirling may also be present.

In FIG. 9, a lumped model may be considered over the length of the drill string. Each section is characterized by its mass as well as specific friction to the wall. Between these individual sections, the lumped model includes elastic elements (spring) which represent the elastic behavior of the drill string along its length.

In conventional drilling, axial force is considered to be applied to the drill string by the control of the unspooling of the drawwork. It is known that the drill string has variation of length due its elastic behavior to the static lading along the string. Due to friction, it is also known that the drill string may move axially only if the local axial loading exceeds the tangent friction force. This is happening typically in "sliding mode". However, when considering the friction such as in section 902, the drill string may require a fair amount of weight slagging at the surface before it begins to move; when it starts moving, friction become smaller and suddenly large force can be transmitted to the bit with risk of damaging this bit. In such condition, the transmission of smooth and steady WOB is quite difficult.

With the application of the present embodiments, an improved force control is achieved by monitoring the axial acceleration of the drill string at different locations (shown in FIG. 9 at 905). By virtue of fast communication without or with low latency (such as through wired drill pipe), the surface control system may be aware of the behavior of the drill string along the length thereof. The distributed measurement of acceleration can also provide the information on axial velocity (first integration of acceleration versus time) and even the local drill string extension (second integration of acceleration versus time). With these three types of information (accel, velocity and extension), the rig control system may estimate the momentum effect of the axially moving mass (acceleration effect) and the elastic energy storage along the drill string. Based on such knowledge, the force transferred to the bit (to create WOB) may be provided by the drawwork as an unsteady effect. The drill strings acts as a low-pass filter, so that the variation created at surface is minimized at the bit. However, the successive impulse of drawwork unspooling allows for the creation of an axial effect along the drill string to combat effectively the static friction, allowing transmission of axial power of low power temporarily while the axial effect is reinforced due to the momentum effect (inertia). Such effect of acceleration and velocity is described in FIG. 10, with reference to each of the sections 901, 902, 903, 904, as well as the drawwork DW. As seen in FIG. 10, a cycle of the response for each section may be observed and learned, as discussed herein.

For proper control of such process, the rig control must have access in real-time or substantially real-time to the distributed accelerations along the drill string. It is understood that near real-time may be within the transmission speed provided for by wired drill pipe, but that conventional mud pulse telemetry may not provide sufficient transmission capability and bandwidth for near real-time. Substantially real-time measurements and analysis allow the drilling control system to tune the shape of the "impulse" to unspool the drawwork (short high amplitude or tapered pattern of the burst). The rig control system may apply multiple patterns of amplitudes of unspooling speed, while measuring the downhole WOB variation versus time, as well as axial acceleration at the bit. After a learning period of time, the control system may apply the "optimum" burst on the drawwork. The rig control system may also use a model of the drill string. Such model would be continuously optimized (as explained in reference to FIG. 8). The usage of such model may reduce the duration of the learning period for the control system to determine the optimum impulse. In the usage of this method, the axial movement of the drill string along the well-bore is not only obtained by "steady axial" force obtained by slagging weight form the hook, but also by using some dynamic effect due to non-uniform axial movement along the well-bore, creating some "hammering effect" to dislodge a sticking effect.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system to control a drilling of a wellbore, comprising:

a drill string within the wellbore, wherein a wired communication system is along the drill string, at least one measurement sub configured to monitor at least one drilling parameter connected to the drill string and the at least one measurement sub being connected to the wired communication system;

a drill bit is at a distal end of the drill string;

a drawwork mechanically coupled to the drill string and configured to lower the drill string attached thereto in the wellbore;

a power controlling electronic connected to a motor of the drawwork, configured to control a drawwork unspooling speed; and a surface controller in communication with the power controlling electronic of the drawwork configured to:

determine at least one drilling parameter along the drill string from measurements taken from the at least one measurement sub, the measurements being transmitted to the controller through the wired communication system;

control the drawwork to increase or reduce a weight-on-bit (WOB) of the drill bit based on the determined drilling parameters; and store a measurement history, wherein the controller comprises a duration for a learning period to predict when to increase or reduce the WOB of the drill bit.

2. The system of claim 1, wherein the controller is configured to adjust a rate of unspooling a drill line at the drawwork.

3. The system of claim 2, wherein the controller is configured to adjust a hook load, wherein the hook load is a weight of the drill string and any other downhole tools used to determine the WOB.

4. The system of claim 1, wherein the wired communication system is a wired drill pipe comprising connections between pipes.

5. The system of claim 4, further comprising network subs installed along the drill string configured to transfer information along the drill string with a compensation of a telemetry signal attenuation.

6. The system of claim 5, wherein the network subs are measurement subs.

7. The system of claim 6, wherein the subs act simultaneously the network subs and the measurement sub and are configured to measure an acceleration, an axial force or a torque.

8. The system of claim 1, wherein the at least one measurement sub comprises an axial force measurement and a torque measurement transmitted along a section of the drill string.

9. The system of claim 1, wherein the at least one measurement sub comprises accelerometers configured to measure an acceleration in an axial direction and a radial direction.

10. The system of claim 1, wherein one of at least two measurement subs is at or proximate the drill bit.

11. The system of claim 1, wherein the controller is configured to select an optimization value for the WOB.

12. The system of claim 11, wherein the optimization value is based on a step change in axial friction and/or a step change in rock properties of a formation surrounding the wellbore.

13. The system of claim 11, wherein the optimization value is based on a repetitive change in axial friction and/or a repetitive change in rock properties of a formation surrounding the wellbore.

14. The system of claim 11, wherein said optimization value is proximate an upper threshold.

15. The system of claim 1, wherein the controller uses a drill string transfer function to tune a mathematical model of the drill string for optimizing the drive of the drawwork.

16. The system of claim 15, wherein the drill string transfer function is based on a surface WOB, a downhole WOB, a drill bit acceleration, and a drawwork speed.

17. A method to control a weight-on-bit (WOB) of a drill bit at a distal end of a drill string in a wellbore, comprising:

driving a drawwork, and the drill string attached thereto, with a controller;

determining a drilling parameter from measurements taken by a wired communication system along the drill string and transmitted along the wired communication system to the controller;

adjusting the drive of the drawwork to increase or reduce the WOB of the drill bit based on the drilling parameter;

adjusting a rate of unspooling a drill line at the drawwork; and distributing acceleration along the drill string by the controller applying impulses or patterns on the rate of unspooling.

18. The method of claim 17, wherein adjusting the drive of the drawwork comprises optimizing the WOB.

19. The method of claim 18, further comprises determining a step change in axial friction and/or a step change in rock properties of a formation surrounding the wellbore.

20. The method of claim 18, further comprises determining a repetitive change in axial friction and/or a repetitive change in rock properties of a formation surrounding the wellbore.

21. The method of claim 17, further comprising transmitting the measurements taken along the drill string and at the drill bit to the controller by the wired communication system.

22. The method of claim 17, further comprising tuning a mathematical model of the drill string for optimizing the drive of the drawwork.

23. The method of claim 17, further comprising real-time processing of the measurements taken along the drill string and at the drill bit.

24. A system to control a drilling of a wellbore, comprising:

a drill string within the wellbore, wherein a wired communication system is along the drill string, at least one measurement sub configured to monitor at least one drilling parameter connected to the drill string and the at least one measurement sub being connected to the wired communication system;

a drill bit is at a distal end of the drill string;

a drawwork mechanically coupled to the drill string and configured to lower the drill string attached thereto in the wellbore;

a power controlling electronic connected to a motor of the drawwork, configured to control a drawwork unspooling speed; and a surface controller in communication with the power controlling electronic of the drawwork configured to:

determine at least one drilling parameter along the drill string from measurements taken from the at least one measurement sub, the measurements being transmitted to the controller through the wired communication system; and control the drawwork to increase or reduce a weight-on-bit (WOB) of the drill bit based on the determined drilling parameters, wherein the controller uses a drill string transfer function to tune a mathematical model of the drill string for optimizing the drive of the drawwork, and wherein the drill string transfer function is based on a surface WOB, a downhole WOB, a drill bit acceleration, and a drawwork speed.

25. The system of claim 24, wherein the wired communication system is a wired drill pipe comprising connections between pipes.

26. The system of claim 24, further comprising network subs installed along the drill string configured to transfer information along the drill string with a compensation of a telemetry signal attenuation.

27. The system of claim 26, wherein the network subs are measurement subs.

* * * * *